United States Patent [19]

Awata et al.

[11] Patent Number: 4,471,192

[45] Date of Patent: Sep. 11, 1984

[54] MICROWAVE HEATING APPARATUS

[75] Inventors: Hidenori Awata, Takarazuka; Masatsune Harada, Torishima; Takehiro Shimizu, Setagaya; Kenichi Abe, Omiya, all of Japan

[73] Assignee: Osaka Gas Kabushiki Kaisha, Osaka, Japan

[21] Appl. No.: 224,557

[22] PCT Filed: Mar. 29, 1980

[86] PCT No.: PCT/JP80/00056

§ 371 Date: Nov. 25, 1980

§ 102(e) Date: Nov. 25, 1980

[87] PCT Pub. No.: WO80/02221

PCT Pub. Date: Oct. 16, 1980

[30] Foreign Application Priority Data

Mar. 31, 1979 [JP] Japan ..... 54-37711
Mar. 31, 1979 [JP] Japan ..... 54-37712

[51] Int. Cl.[3] ..... F26B 23/08; H05B 6/64

[52] U.S. Cl. ..... 219/10.55 A; 34/1; 219/10.55 R

[58] Field of Search ..... 219/10.55 R, 10.55 A, 219/10.55 F

[56] References Cited

U.S. PATENT DOCUMENTS 3,056,877 10/1962 Schmidt et al. ..... 219/10.55 R
3,263,052 7/1966 Jeppson et al. ..... 219/10.55 A
3,739,130 6/1973 White ..... 219/10.55 R
3,783,221 1/1974 Soulier ..... 219/10.55 A

FOREIGN PATENT DOCUMENTS 51-14737 5/1976 Japan ..... 219/10.55 A
1117753 6/1968 United Kingdom ..... 219/10.55 A

*Primary Examiner*—B. A. Reynolds
*Assistant Examiner*—Alfred S. Keve
*Attorney, Agent, or Firm*—Leonard Bloom

[57] ABSTRACT

A microwave heating apparatus of a dielectric heating system used in combination with a radiant heat source.

A leakage waveguide group is formed by arranging a number of leakage waveguides, each having at least in one side surface thereof an electric wave radiation opening which may be in the form of a long slit; and the same is closed at each electric wave radiation opening thereof with heat resistant non-metal material such as Teflon, glass or the like and is arranged so that a heating medium such as hot air, steam or the like may be passed therethrough.

According to this construction, as compared with a conventional microwave heating apparatus of this kind, the heating energy is more sufficiently consumed in an object to be heated, so that the heating speed can be improved and the available space in the heating chamber can be enlarged.

8 Claims, 4 Drawing Figures

Figure 2:
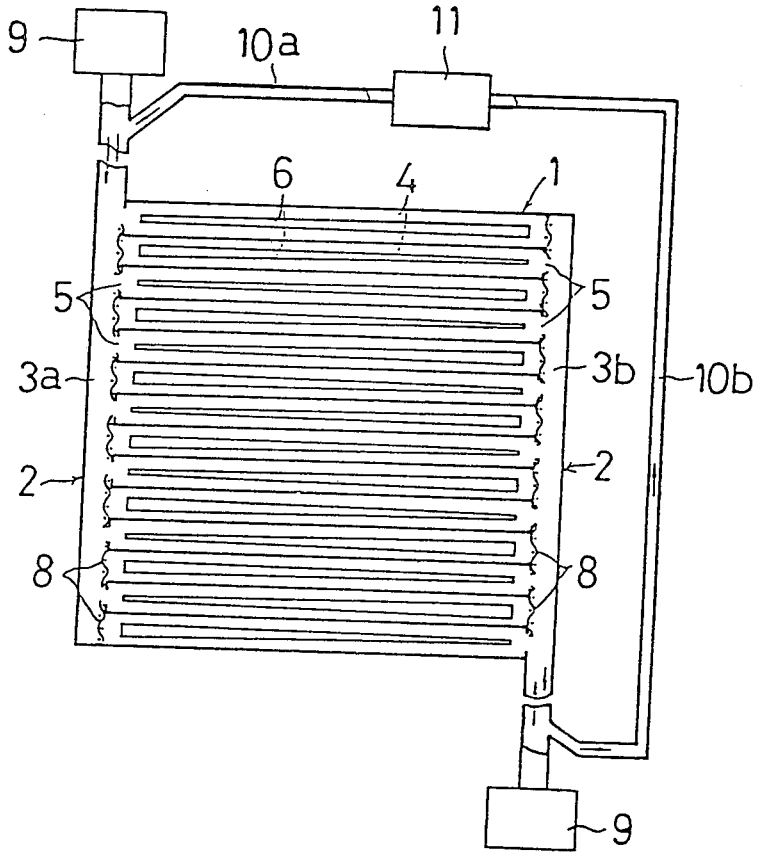

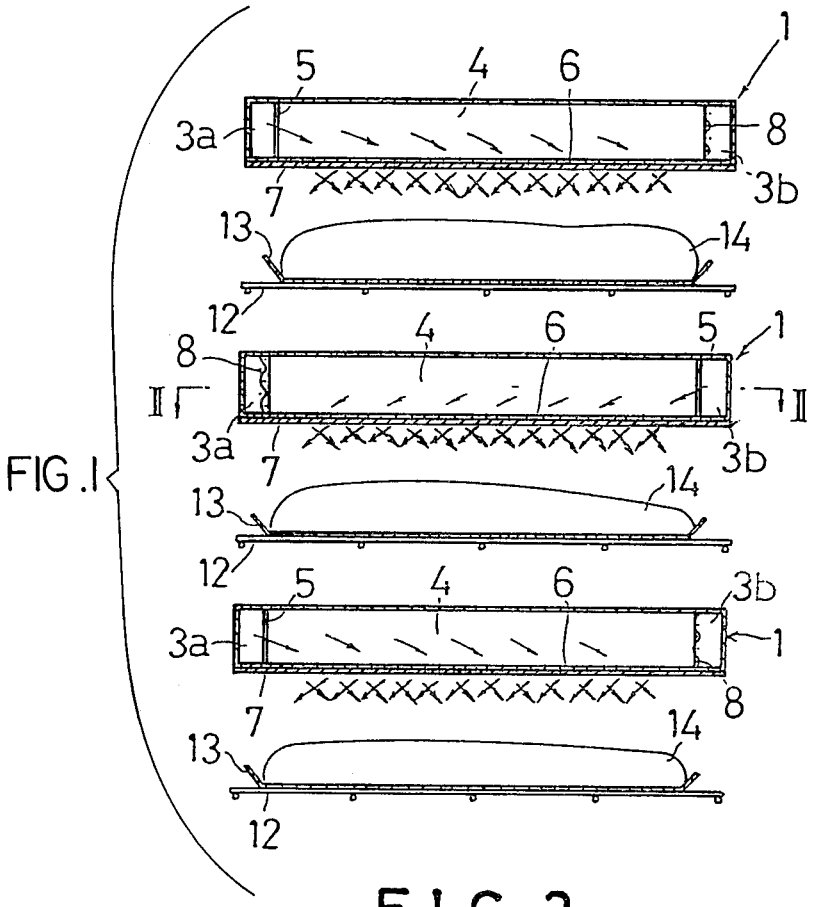
FIG.3
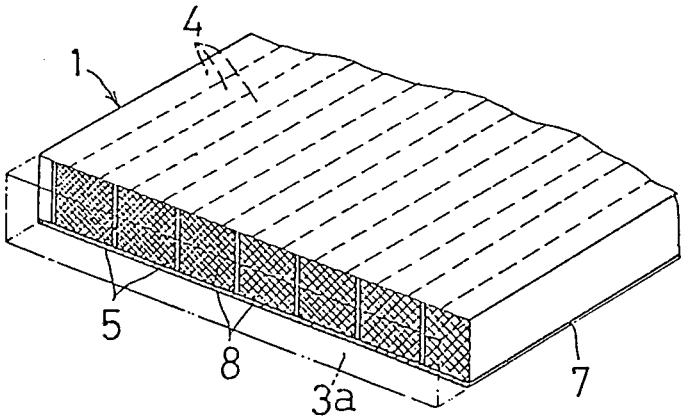

MICROWAVE HEATING APPARATUS

DESCRIPTION

TECHNICAL FIELD

This invention relates to a microwave heating apparatus which is effective not only as a common heating apparatus but also especially as a heating apparatus of a freeze-drying apparatus or a vacuum-drying apparatus for foodstuff.

BACKGROUND ART

Freeze-drying or vacuum-drying for foodstuff can provide a produce more excellent in quality than that by normal pressure heat drying, and therefore is used reputably as a means of process for preservation foodstuffs or space foodstuffs. However, there has been adopted in that process a surface heat drying system by a radiant heat source, so that if the radiant heat thereof is increased in thermal volume in order to shorten the drying time, the surface temperature of the foodstuff is raised to excess and cells of the foodstuff are dried hard or tissue thereof is damaged, and as a result the foodstuff is changed in color or flavor. Accordingly, it has been necessary to take the drying time of 6–10 hours for obtaining a food product good in quality.

In view of this, the inventors of the present invention have previously succeeded in shortening the drying time by using a microwave heating apparatus capable of heating a material to be heated from the central portion thereof, jointly with a radiant heat source. However, the conventional microwave heating apparatus is so arranged that an electric wave may radiate onto a material to be heated substantially perpendicularly thereto, so that there is involved such an inconvenience that an electric wave transmission distance through the material to be heated is short and the heating energy thereof is not effectively consumed. Additionally, the same has to provide in a heating chamber a heat generating plate or the like serving as a radiant heat source, so that there is involved such an inconvenience that an effectively available space in the heating chamber is small.

DISCLOSURE OF THE INVENTION

This invention has for its object to provide a microwave heating apparatus free from those inconveniences, and it is characterized in that a leakage waveguide group is formed by arranging a number of leakage waveguides, each having at least in one side surface thereof an electric wave radiation opening in the form of a long slit or a series of openings spaced one from another (much in the nature of "stepping stones"), and the same is closed at each electric wave radiation opening thereof with heat resistant non-metal material such as Teflon, glass or the like and is so arranged that a heating medium such as hot air, steam or the like may be directed or passed therethrough.

Thus, according to this invention, since the leakage waveguide group is formed by arranging a number of leakage waveguides, each having at least in one side surface thereof an electric wave radiation opening in the form of a long slit or a series of spaced openings, it is advantageous in that there can be removed the foregoing inconveniences with the conventional microwave heating apparatus in which an electric wave is radiated onto the material to be heated substantially perpendicularly thereto, and that the heating speed can be improved as compared with that in the conventional one and the drying time can be shortened.

Additionally, the leakage waveguide group is closed at each electric wave radiation opening thereof with the heat resistant non-metal material such as Teflon, glass or the like and is so arranged that a heating medium such as hot air, steam or the like may be passed therethrough, and thus the leakage waveguide which radiates an electric wave from the electric wave radiation opening thereof is utilized as a thermal radiator, and consequently there can be removed the foregoing inconvenience with the conventional microwave heating apparatus of this kind in which a heat generating plate or the like serving as a radiant heat source is provided in a heating chamber, and thus it is advantageous in that there can be provided such one that an available space in a heating chamber is large, and there can be obtained practically a new type heating apparatus which is high in industrial value.

Additionally, since it is so arranged that an electric wave may be distributively radiated from the electrical wave radiation opening such as a long slit or the like in the leakage waveguide, a terminal voltage of the leakage waveguide is lowered, and accordingly it is advantageous in that when this invention apparatus is used as a heating apparatus of a vacuum-drying container or apparatus, there is not generated such an electric discharge as caused by the conventional microwave heating apparatus, and consequently a heating capacity thereof can be kept in nearly equal to that in the case of a common use thereof.

BRIEF DESCRIPTION OF THE FIGURES IN THE DRAWINGS

Figure 4:
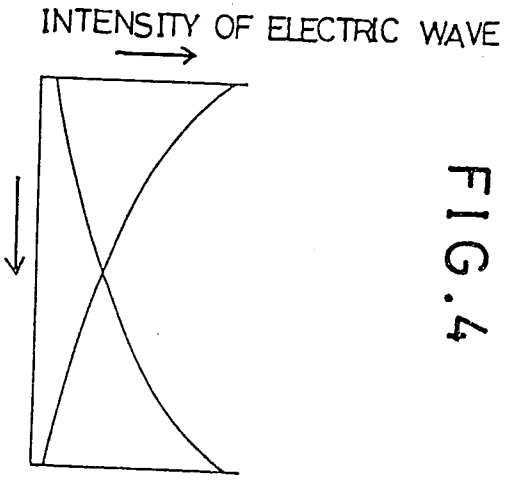

FIG. 1 is a vertically sectional front view of one exemplified microwave heating apparatus of this invention, FIG. 2 is a sectional view taken along the lines II—II in FIG. 1, FIG. 3 is a perspective view, partly omitted, of a leakage waveguide assembly and FIG. 4 is a diagram showing the relations between the intensity of an electric wave radiated from a slit which is an electric wave radiation opening of a leakage waveguide and the distance of the slit.

BEST MODE FOR CARRYING OUT THE INVENTION

An embodying example of this invention will be explained with reference to the accompanying drawings.

Referring to FIGS. 1 to 3, numeral 1 denotes a leakage waveguide assembly, and the assembly 1 is disposed in three stages in upper and lower relationships.

The leakage waveguide assembly 1 is composed of a pair of right and left leakage waveguide groups 2,2.

The leakage waveguide groups 2,2 are constructed to be in the form of teeth of a comb in such a manner that a number of leakage waveguides 4 (seven ones in the drawings) of each group are connected through respective connecting slits 5 to each of waveguides 3*a*,3*b*. And a pair of right and left ones 2,2 thereof are disposed in such a manner that their comb teeth portions are alternately brought to be in engagement one with another so that form the leakage waveguide assembly 1 may be constructed.

The leakage waveguide 4 is provided in one side surface or wall with at least one microwave irradiating opening formed therein. Preferably, the opening comprises a slit 6 (formed in the longitudinal direction of the waveguide as shown more clearly in FIG. 2) and the slit 6 is provided on its upper surface or lower surface with a closing plate 7 made of heat resistant non-metallic material such as glass, Teflon or the like which permits an electric wave to transmit therethrough. The leakage waveguides 4,4 are provided at their rearward end boundaries or portions between the end portions and the waveguides 3*a*,3*b*, with electric wave screen members 8,8 (which may be formed from) a metallic net or other suitable material which preclude and do not permit an electric wave to pass therethrough but which permit a heating medium such as hot air, steam or the like to pass therethrough.

The waveguides 3*a*,3*b* are connected, respectively, with oscillation apparatus 9,9 comprising magnetrons or the like, and are connected through respective conduit pipes 1O*a*,1O*b* with a hot blast generating apparatus 11 (or an apparatus for generating a heating medium such as steam or the like) the respective conduit pipes thereby forming a closed circuit for the heating medium as shown more clearly in FIG. 2. Moreover, again as shown in FIG. 2, the oscillation apparatus 9,9 comprising the microwave generating means are so connected to the respective comb assemblies that the microwave energy enters from mutually opposite directions.

Referring to FIG. 1, numeral 12 denotes a rack of grid form, and numeral 13 denotes a metallic receiving pan which receives foodstuffs to be heated 14 and is placed on the rack 12.

Since this invention apparatus is constructed as above, the electric waves generated at the oscillation apparatus 9,9 are passed into the leakage waveguides 4,4 of the comb teeth portions after passed through the connecting slits 5,5 from the waveguides 3*a*,3*b*, and are radiated, as shown by arrows in FIG. 1, from the slits 6 in an oblique direction at an angle determined by a free space wave length and a transmission wave length of the electric wave, and are reflected by the metallic receiving pan 13, and thus the electric waves pass in the form of V through the interior of the foodstuffs to be heated 14. As a result, the electric wave transmission distance in the foodstuffs to be heated 14 is elongated, and the heating energy of the electric wave is sufficiently consumed therein, so that the foodstuffs to be heated 14 can be dried by heat for a short period of time as compared with the case in the conventional apparatus.

The electric wave radiated from the long slit 6 is damped in its intensity, as shown in FIG. 4. accordingly as it goes from the connecting portion of the leakage waveguide 4 with each of the waveguides 3*a*,3*b* towards its rearward end (the connecting portion thereof with the waveguide 3*a* is on the left side and the connecting portion thereof with the waveguide 3*b* is on the right side in the same Figure.), so that the heating temperatures by the respective electric waves are differentiated one from another at the left portion and the right portion of the foodstuff to be heated 14. However, since the leakage waveguides 4,4 in which the electric wave advancing directions are in opposite one to another are disposed alternately, the foodstuff to be heated 14 can be heated nearly uniformly.

Additionally, the slit 6 is shaped into one which is gradually larger in width towards its rearward end, that is, gradually wider towards the rearward end portion of the respective waveguide so that a damping degree of the electric wave that is damped accordingly as it goes towards the rearward end of each of the leakage waveguides 4,4 is smaller than that in the case of a slit which is equal in width, and in this way the foodstuff to be heated 14 can be heated more uniformly if the shape of the slit is properly designed.

Meanwhile, the hot air generated by the hot air generating apparatus 11 is circulated as shown by shorter arrows in FIG. 2 in order of the conduit pipe 1O*a*→the waveguide 3*a*→the leakage waveguides 4,4 . . . →the waveguide 3*b*→the conduit pipe 1O*b*→the hot air generating apparatus 11, so that the leakage waveguides 4,4 . . . act as a thermal radiator and the foodstuff to be heated 14 is heated by the heat radiated from the surfaces thereof.

According to this apparatus, as above, the foodstuff to be heated 14 is heated from the center portion thereof by the electric wave radiated from the slit 6 and at the same time is heated from the surface thereof by the heat radiated from the leakage waveguide 4, and thus by the cooperation thereof the same is dried faster than not only by the conventional heating apparatus alone but also by the microwave heating apparatus used together with a radiant heat source.

In the foregoing example, the leakage waveguides 2,2 are arranged so that the electric waves may be passed in the mutually opposite directions and also the slit 6 is gradually wider towards the rearward end thereof, but it may be so modified that the electric waves may be passed in the same directions and that the slit 6 may be shaped so as to be equal in its width.

Further, the use of the metallic receiving pan 13 serving as an electric wave reflecting plate may be abolished, and the lower stage leakage waveguide group 2 is brought to be as nearest as possible to the foodstuff to be heated 14 so that the upper side surface thereof may serve as an electric wave reflecting plate. Furthermore, the lower stage leakage waveguide 4 may be provided in its upper side surface also with the slit 6, so that the foodstuff to be heated 14 can be radiated by electric waves from above and below.

Almost the same advantageous effect can be obtained even if the electric wave radiation opening is in the form of stepping stones as hereinbefore described.

Furthermore, if, though not illustrated, an adjusting plate for adjusting the slit width is provided on one side surface of the leakage waveguide 4 having the slit 6 so that the gradually larger width condition of the slit 6 may be changed by the same, the optimum heating suitable for the condition of the foodstuff to be heated 14 can be obtained.

It will also be appreciated that, if desired, at least two leakage waveguide groups may be disposed in plural stages, that is, stacked up relative to one another with a space between adjacent groups.

Obviously, many modifications may be made without departing from the basic spirit of the present invention. Accordingly, it will be understood by those skilled in the art that within the scope of the appended claims, the invention may be practiced other than has been specifically described herein.

We claim:

1. A microwave heating apparatus comprising at least one leakage waveguide, said waveguide including a forward end portion and a rearward end portion, said waveguide further including a side wall having at least one microwave irradiating opening formed therein, means including a heat-resistant non-metallic material for closing said irradiating opening in said waveguide, microwave generating means coupled to said forward end portion of said waveguide, heating medium generating means coupled to said forward end portion of said waveguide, and means including a material covering said rearward end portion, said last-named means precluding passage of the microwave energy through said rearward end portion but permitting passage of the heating medium therethrough out of said waveguide.

2. The microwave heating apparatus of claim 1, wherein a plurality of said leakage waveguides are provided in parallel with each other, wherein a common waveguide is connected to one side of said waveguides, thereby forming a first comb assembly, and wherein a common waveguide is connected to the other side of said waveguides, thereby forming a second comb assembly meshing with said first comb assembly.

3. The microwave heating apparatus of claim 2, wherein said microwave generating means is connected to said first comb assembly, and wherein another microwave generating means is connected to said second comb assembly, whereby the microwave energy enters said first and second comb assemblies from mutually opposite directions.

4. The microwave heating apparatus of claim 1, wherein said microwave irradiating opening comprises a long slit formed in the longitudinal direction of said waveguide, said slit being gradually wider towards said rearward end portion of said waveguide.

5. The microwave heating apparatus in any one of claims 1 through 4, further including a reflecting pan facing the microwave irradiating opening, whereby foodstuffs to be heated may be received in the pan.

6. The microwave heating apparatus in any one of claims 1 through 4, wherein at least two leakage waveguide groups are disposed in plural stages, the adjacent group having a space therebetween.

7. The microwave heating apparatus of claim 2, further including respective conduit pipes connecting said heating generating means to said respective common waveguides, whereby a closed circuit is formed for said heating medium.

8. The microwave heating apparatus of claim 1, wherein said leakage waveguide is placed within a vacuum container.

* * * * *

UNITED STATES PATENT AND TRADEMARK OFFICE

CERTIFICATE OF CORRECTION

PATENT NO. : 4,471,192

DATED : Sept. 11, 1984

INVENTOR(S) : Hidenori Awata et al.

It is certified that error appears in the above-identified patent and that said Letters Patent is hereby corrected as shown below:

On the title page, Item /73/ should read:

---/73/ Assignee: Osaka Gas Co., LTD., Osaka, Japan and Kabushiki Kaisha Sofard, Toyko, Japan---.

Signed and Sealed this

Second Day of April 1985

[SEAL]

*Attest:*

DONALD J. QUIGG

*Attesting Officer* *Acting Commissioner of Patents and Trademarks*